United States Patent [19]

Lohonen

[11] 3,947,150

[45] Mar. 30, 1976

[54] AXIAL TURBINE SPLIT DIAPHRAGM LOCKING DEVICE

[75] Inventor: Paavo Lohonen, Finspong, Sweden

[73] Assignee: Stal-Laval Turbin AB, Finspong, Sweden

[22] Filed: Dec. 9, 1974

[21] Appl. No.: 530,825

[30] Foreign Application Priority Data

Jan. 15, 1974 Sweden ..... 7400460

[52] U.S. Cl. ..... 415/219 R; 415/217

[51] Int. Cl.[2] ..... F01D 9/00

[58] Field of Search ..... 415/216, 217, 219 R

[56] References Cited

UNITED STATES PATENTS

| | | | |
|---|---|---|---|
| 1,352,276 | 9/1920 | Junggren | 415/217 |
| 1,362,437 | 12/1920 | Robb | 415/217 |
| 2,013,512 | 9/1935 | Birmann | 415/217 |
| 2,247,387 | 7/1941 | Johnson et al. | 415/219 R |
| 2,247,423 | 7/1941 | Webster, Jr. | 415/219 R |
| 3,861,827 | 1/1975 | Peabody | 415/219 R |

*Primary Examiner*—Henry F. Raduazo

*Attorney, Agent, or Firm*—Eric Y. Munson

[57] ABSTRACT

An adjustable locking device facilitates the insertion and removal of a diaphragm upper half in the upper portion of the split housing of an axial turbine. The diaphragm upper half is provided with a slot at its outer edge which permits the turbine housing locking pin to pass therethrough. An eccentric pivot locking device positioned in the slot is rotated to close the slot and secure the diaphragm half in the turbine housing relative to the pin. Slots may be provided at both edges of the diaphragm half or at only one edge while the other edge contains a bore hole recess to receive a corresponding locking pin of the housing. Set screw means associated with the locking device may be provided for further security.

6 Claims, 6 Drawing Figures

AXIAL TURBINE SPLIT DIAPHRAGM LOCKING DEVICE

BACKGROUND OF THE INVENTION

This invention relates to split housing axial turbines and, more particularly, to a locking device to facilitate insertion and removal of a diaphragm upper half, secured in the upper portion of the turbine housing, when assembling and disassembling the turbine.

The diaphragms located between the turbine wheels mounted on a rotor enclosed within the horizontally split housing of an axial turbine are also split into two parts. Thus, the turbine has a horizontal shaft and the turbine housing and the diaphragms are divided along a horizontal axial section, with each portion of a diaphragm arranged in a respective portion of the turbine housing. The diaphragms are mounted relatively loosely in slots in the turbine housing, in order to allow for thermal expansion and contraction of the housing and the diaphragms in relation to one another, and are preferably secured against rotation in the slots. Generally, no special joint between the two halves of a diaphragm is required. The lower portion of a diaphragm is placed in a corresponding slot in the lower portion of the turbine housing, while the upper portion of the diaphragm is secured in some manner in the upper portion of the housing until the housing halves and the diaphragm halves been properly aligned and joined together.

The upper portion of a diaphragm may be secured to the upper portion of the turbine housing for alignment with the diaphragm bottom portion upon joining of the housing portions by means of pins carried in the turbine housing inner wall. These pins project into corresponding recesses in the diaphragm outer peripheral surface. However, the positioning of the diaphragm upper portion and the turbine housing upper portion is not easily accomplished due to the presence of these projecting securing pins which interfere with convenient placement. Thus, the present arrangements do not permit the easy insertion and removal of the diaphragm upper portion when assembling and disassembling the turbine.

SUMMARY OF THE INVENTION

The present invention overcomes the disadvantages associated with the aforementioned diaphragm securing means and facilitates the insertion and removal of the diaphragm upper portion in the turbine housing upper portion when assembling and disassembling the turbine. This is accomplished, according to the invention, through the provision of a locking device positioned in the diaphragm upper portion in conjunction with the provision of a slot in at least one outer edge of the diaphragm upper portion.

The corresponding securing pin in the turbine housing projects into and passes through the slot so that the diaphragm upper portion is not blocked from placement and positioning within the housing. Once the diaphragm is positioned, the diaphragm and the housing are secured relative to one another by virtue of a locking device located in the slot. This locking device may take the form of an eccentric pivot means positioned in the slot above the location of the securing pin projecting therein. By pivoting this locking device, the slot is closed or blocked so that the securing pin can not move therein and the diaphragm upper portion is secured in the housing preventing its removal.

Thus, it is a feature of this invention to provide a locking device for securing a split diaphragm portion in a turbine housing of an axial turbine while at the same time enabling convenient insertion and removal of the diaphragm portion when assembling and disassembling the turbine.

BRIEF DESCRIPTION OF THE DRAWINGS

The foregoing advantages and features of this invention will be more fully understood from the following description with reference to the accompanying drawings in which.

DETAILED DESCRIPTION OF THE PREFERRED EMBODIMENT

Figure 1:
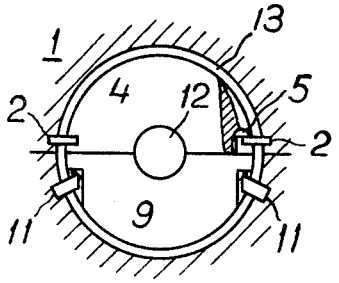
FIG. 1 is a cross sectional view through an axial turbine housing in the region surrounding a split diaphragm.

Referring to FIG. 1, there is schematically shown a section through that portion of an axial turbine housing 1 which surrounds a diaphragm consisting of an upper diaphragm portion or half 4 and a lower diaphragm portion or half 9. The diaphragm may be of the type normally utilized as a support for guide vanes, not shown, or may also be formed as an entire blank diaphragm which functions to separate two turbine parts from one another. The diaphragm has an opening in the center for a turbine shaft 12. A space or gap 13 exists between the diaphragm, made up of halves 4 and 9, and the turbine housing 1 to permit thermal movement between the parts.

As seen in FIG. 1, the lower diaphragm half 9 rests freely on the pins or supports 11 which may be adjustable so that the vertical position of the horizontal partition line splitting the diaphragm may be adjustably fixed in relation to the turbine shaft as required. Thus, a degree of horizontal movement is permitted through use of the adjustable supports 11. The diaphragm upper half 4 is retained within the upper half of the turbine housing 1 by means of the pins 2 projecting from the housing and engaging recesses in the diaphragm portion.

Figure 2:
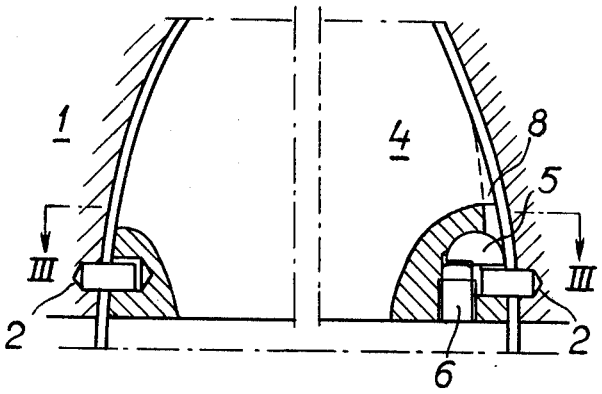
FIG. 2 is an enlarged view, partly in section, showing the outer edges of the diaphragm upper portion in relationship to the turbine housing in secured position therein with the locking device locked.
Figure 4:
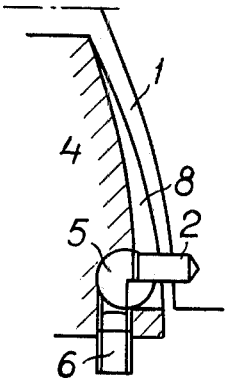
FIG. 4 is a view similar to FIG. 2 showing the outer edge of the diaphragm upper portion in relationship to the turbine housing with the locking device in unlocked position permitting insertion and removal of the diaphragm during assembly and disassembly of the turbine.

FIGS. 2 and 4 show an enlarged view of the lower outer corners of the diaphragm upper half 4, in partial section, revealing the support pins 2 and the corresponding recesses in the diaphragm. The support pin at the left, looking at FIG. 2, extends into a recess which is a simple bore hole of slightly larger dimensions than the pin 2. The recess at the right is formed as a slot, illustrated at 8, at the lower circumferential edge of the diaphragm upper half. This slot 8 allows the pin 2 at the right edge, and the diaphragm upper half, to pass freely relative to one another. Thus, when the diaphragm upper half 4 is inserted in the upper portion of the turbine housing and moved relative to the right side of the housing, the pin 2 projects into the slot 8 and passes freely from the top of the slot to the bottom of the slot. The slot 8 can be seen in a top view in FIG. 3 which also shows the diaphragm provided with a flange guided in a slot 3 in the turbine housing.

Figure 3:
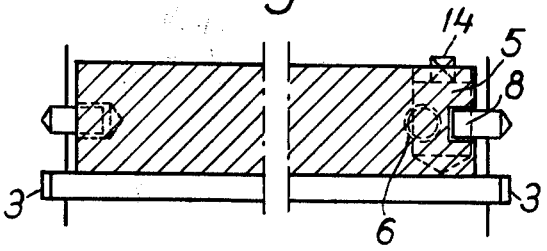
FIG. 3 is a top view, partly in section, of the diaphragm upper portion taken along the line 3—3 of FIG. 2.
Figure 5:
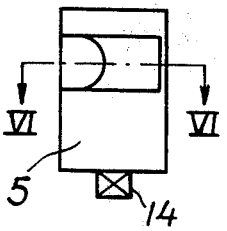
FIG. 5 is a top view of an embodiment of the locking device according to this invention.

Once the pin 2 on the right side of the housing is in place, the slot 8 is blocked by pivotal movement of the eccentric wedge 5 positioned in the slot of the diaphragm upper half. Referring to FIGS. 3 and 5, it can be seen that the eccentric wedge 5 provided in the diaphragm slot 8 is a rotatable cylinder having a stepped recess 15 shown in FIG. 6. When in position for insertion of the diaphragm in the housing, the recess 15 forms a continuation of the slot so that the pin 2 may pass. When rotated or pivoted, the wedge 5 blocks the slot 8 and prevents movement of the diaphragm relative to the pin 2 to remove the diaphragm portion.

The diaphragm upper half 4 is inserted in the housing by first inclining it to the horizontal a slight degree so that the left pin 2 is fitted into the corresponding bore hole in the left corner of the diaphragm. Following this, the right corner of the diaphragm is put into proper position, as shown in FIG. 4, since the slot 8 carries the right pin 2. As seen in FIG. 4, the eccentric cylinder wedge 5 is in its open position permitting insertion of the upper diaphragm half 4. Once the diaphragm portion is in position, the wedge 5 is rotated 90°, by means of the squareshaped pin 14 at its end, as seen in FIGS. 3 and 5, to block the slot as shown in FIG. 2. The wedge 5 now rests on the right pin 2 so that the diaphragm upper half 4 is secured in the upper housing of the turbine. Also seen, in FIG. 2, is a screw 6 which may be screwed in from below the wedge as a set screw so that the wedge is locked. Advantageously, the recess for the set screw 6 communicates with the surface of the diaphragm portion at the dividing plane of the diaphragm.

Figure 6:
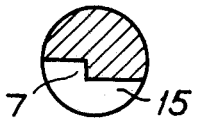
FIG. 6 is a sectional view through the locking device showing the recess therein for receiving a securing pin.

The details of construction of the wedge 5 are most clearly seen in FIGS. 5 and 6. The wedge 5 is designed as a cylinder with the square shaped pin 14 at one end. A recess 15 extends approximately half way through the cylinder body. Advantageously, the recess may be stepped so that it is deeper where the screw 6 is inserted. The stepped surface, formed as shown at 7 in FIG. 6, a section taken through the recess 15, results in the screw 6 and the wedge 5 being mutually locked. A similarly advantageous locking and securing of the diaphragm in place can be obtained by making the cylinder 5 longer, if the thickness of the diaphragm permits, and displacing the set screw 6, and its recess, in relation to the slot 8 and the recess for the pin 2. In this manner two different recesses, approximately perpendicular to one another, are obtained with the recess for the screw 6 being provided in the shape of a sector of the cylinder while the recess for the pin 2 is in the form of a segment through the cylinder. A further alternative is to provide the screw 6 with a large diameter in relation to the wedge 5 and positioning the screw such that it overlaps the center line of wedge 5. Thus, a double-sided locking can be obtained. It will be understood by those skilled in this art that slot recess means may be advantageously provided on both edges of the diaphragm and that the securing and locking means described are applicable to turbine components other than diaphragms having the same insertion and removal characteristics. While generally not required, the locking means may be utilized with the lower diaphragm portion provided suitable adaptations are made.

I claim:

1. In an axial turbine having a split housing including an upper and a lower portion, a rotor having turbine wheels and diaphragms between the turbine wheels, the diaphragms being divided into two portions, each portion being secured in respective upper and lower turbine housing portions, the improvement comprising means for conveniently removably securing the diaphragm upper portion in the housing upper portion comprising securing pin means positioned within the housing on each side thereof, recess means located on opposite sides of the periphery of the diaphragm upper portion, at least one of the recess means extending in the form of a slot means for permitting the corresponding securing pin means to pass freely therein when inserting and removing the diaphragm upper portion in the housing and locking pivot means permanently positioned in the diaphragm upper portion slot for pivotal movement from a position in which the slot is open and the securing pin passes freely therein to a position in which the pivot means blocks the slot preventing movement of the pin therein for locking the diaphragm relative to the securing pin means by preventing the pin means movement in the slot means and thereby securing the diaphragm in the housing upper portion.

2. The improvement as claimed in claim 1 where the pivot means is an eccentric wedge.

3. The improvement as claimed in claim 1 wherein the locking means further includes a set screw, the set screw being positioned in a recess within the diaphragm upper portion communicating with the diaphragm surface at its dividing plane and with the pivot means so that the set screw may be tightened to contact the pivot means and lock it in position.

4. The improvement as claimed in claim 3 wherein the pivot means comprises a cylindrical means having a recess cooperating with the slot to permit passage of the securing pin means and a recess for receiving the set screw.

5. The improvement as claimed in claim 4 wherein the set screw recess communicates with the recess for the securing pin means.

6. The improvement as claimed in claim 4 wherein the set screw recess is displaced relative to the recess for the securing pin means.

* * * * *